US005198131A

United States Patent [19]

Hsu et al.

[11] Patent Number: 5,198,131

[45] Date of Patent: Mar. 30, 1993

[54] DIALKANO- AND TRIALKANOL AMINE-DERIVED THIOESTER MULTIFUNCTIONAL ANTIWEAR ADDITIVES

[75] Inventors: Shih-Ying Hsu, Morrisville, Pa.; Andrew G. Horodysky, Cherry Hill, N.J.

[73] Assignee: Mobil Oil Corporation, Fairfax, Va.

[21] Appl. No.: 815,018

[22] Filed: Dec. 27, 1991

[51] Int. Cl.[5] ..... C10M 135/26; C07C 323/52

[52] U.S. Cl. ..... 252/47.5; 560/147

[58] Field of Search ..... 252/47.5; 560/147

[56] References Cited

U.S. PATENT DOCUMENTS

| | | | |
|---|---|---|---|
| 2,223,130 | 11/1940 | Prutton | 252/47.5 |
| 2,238,478 | 4/1941 | Elsmere | 252/47.5 |
| 2,257,752 | 10/1941 | Lincoln et al. | 252/47.5 |
| 2,268,185 | 12/1941 | Burke et al. | 560/147 |
| 2,330,239 | 9/1943 | Prutton | 252/47.5 |
| 2,614,980 | 10/1952 | Lytle | 252/47.5 |
| 4,201,684 | 5/1980 | Malec | 252/47.5 |
| 4,515,687 | 5/1985 | Bresson et al. | 252/61 |
| 4,761,482 | 8/1988 | Karol | 548/142 |
| 4,863,534 | 9/1989 | Forsberg | 149/2 |
| 4,919,831 | 3/1990 | Horodysky | 252/47.5 |
| 4,994,150 | 2/1991 | Shaw | 560/147 |

*Primary Examiner*—Prince Willis, Jr.
*Assistant Examiner*—Alan D. Diamond
*Attorney, Agent, or Firm*—Alexander J. McKillop; Malcolm D. Keen; Howard M. Flournoy

[57] ABSTRACT

Dialkanol- and trialkanol amine-derived thioesters have been found to be effective multifunctional antiwear additives for lubricants and fuels.

16 Claims, No Drawings

DIALKANO- AND TRIALKANOL AMINE-DERIVED THIOESTER MULTIFUNCTIONAL ANTIWEAR ADDITIVES

BACKGROUND OF THE INVENTION

1. Field of the Invention

This application is directed to alkanol-amine-derived thioesters as multifunctional additives in lubricants and fuels.

2. Description of Related Art

Sulfur-containing compounds have been known to provide antiwear properties on metal parts in lubricants. The protection is believed to come from surface-active sulfur groups and other functionalities which may be induced to form a preferable conformation under service conditions U.S. Pat. No. 4,863,534 describes secondary and tertiary alkanol amines as being useful in the preparation of solubilizers useful in dispersing oil-soluble, water-insoluble functional additives in water-based functional fluids.

Now, thioesters derived from alkanol amines have been found to provide superior multifunctional antiwear performance with potential antifatigue, anticorrosion, antirust, cleanliness and thermal stabilizing/antioxidant characteristics.

BRIEF SUMMARY OF THE INVENTION

The present invention is directed to amine-derived thioesters as highly efficient multifunctional antiwear additives for various lubricants. More particularly, the additives in accordance with the present invention are derived from dialkanol- and trialkanol amines and a suitable sulfur source. These additives are also believed to be useful in hydrocarbyl or hydrocarbyloxy fuels.

An object of this invention is to provide improved lubricant and fuel compositions comprising a major amount of said lubricant or fuel and a minor amount of the aforementioned alkanol amine-derived thioester additives.

DESCRIPTION OF THE PREFERRED EMBODIMENTS

A preferred preparation of the subject amine-derived thioesters is described in FIGS. 1 and 2 below.

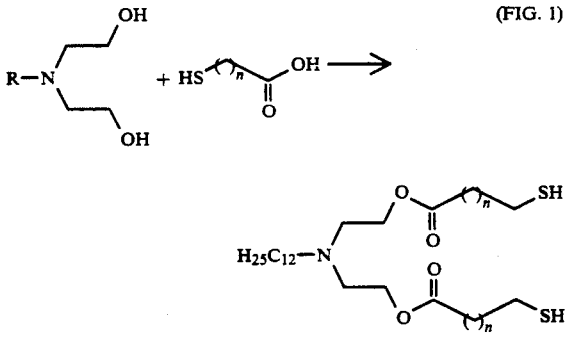

(FIG. 1)

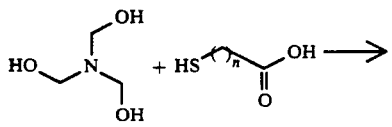

(FIG. 2)

-continued

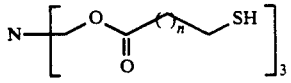

Where n equals 1—100 and preferably 1 or 2.

R equals $C_1$ to about $C_{60}$, preferably $C_{12}$ to about $C_{18}$.

Suitable alkanolamines include but are not limited to the following: triethanol amine, diethanol amine, dipropanol amine, tripropanol amine and the like, bis-(hydroxyethyl)-cocoamine and the like.

Any suitable sulfur source may be used. However, mercaptans or mercapto-derived compounds which contain at least one carboxylic functionality are preferred. Useful sulfur sources include but are not limited to the following: thioglycolic acid, 3-mercaptopropionic acid, thiolactic acid, thiomalic acid, dithiodiglycolic acid, thiodiglycolic acid, and thiodipropionic acid.

Conditions for the above reactions may vary widely depending upon specific reactants, the presence or absence of a solvent and the like. Any suitable set of reaction conditions known to the art may be used. Generally stoichiometric quantities of reactants are used. However, more than molar or less than molar or equimolar amounts may be used. The reaction conditions may vary as follows: the reaction temperature may vary from ambient or 25° C. to about 300° C., the pressure may vary from ambient or about 1 atm to about 10 atm and the molar ratio of reactants preferably varies from about 1:10 moles to about 10:1 moles of alkanol amine to sulfur source.

The additives embodied herein are utilized in lubricating oil or grease compositions in an amount which imparts significant antiwear characteristics to the oil or grease as well as reducing the friction of engines operating with the oil in its crankcase. Concentrations of about 0.001 to about 10 wt. % based on the total weight of the composition can be used. Preferably, the concentration is from 0.1 to about 3 wt. %. It is expected that these materials would also be suitable for use in liquid hydrocarbyl or alcoholic or mixed hydrocarbyl/alcoholic or oxygenated fuel compositions. They are utilized in fuels in amounts of from about 25 to 500 pounds of additive per thousand barrels of fuel and preferably from about 50 to about 250 pounds per 1000 barrels of fuel.

The additives have the ability to improve the above noted characteristics of various oleagenous materials such as hydrocarbyl lubricating media which may comprise liquid oils in the form of either a mineral oil or a synthetic oil, or in the form of a grease in which the aforementioned oils are employed as a vehicle.

In general, mineral oils, both paraffinic, naphthenic and mixtures thereof, employed as the lubricant, or grease vehicle, may be of any suitable lubricating viscosity range, as for example, from about 45 SSU at 100° F. to about 6000 SSU at 100° F. and preferably, from about 50 to about 250 SSU at 210° F. These oils may have viscosity indexes ranging to about 95 are preferred. The average molecular weights of these oils may range from about 250 to about 800. Where the lubricant is to be employed in the form of a grease, the lubricating oil is generally employed in an amount sufficient to balance the total grease composition, after accounting for the desired quantity of the thickening agent, and other additive components to be included in the grease formulation.

A wide variety of materials may be employed as thickening or gelling agents. These may include any of the conventional metal salts or soaps, which are dispersed in the lubricating vehicle in grease-forming quantities in an amount to impart to the resulting grease composition the desired consistency. Other thickening agents that may be employed in the grease formulation may comprise the non-soap thickeners, such as surface-modified clays and silicas, aryl ureas, calcium complexes and similar materials. In general, grease thickeners may be employed which do not melt and dissolve when used at the required temperature within a particular environment; however, in all other respects, any materials which is normally employed for thickening or gelling hydrocarbon fluids for foaming grease can be used in preparing grease in accordance with the present invention.

In instances where synthetic oils, or synthetic oils employed as the lubricant or vehicle for the grease, are desired in preference to mineral oils, or in combination therewith, various compounds of this type may be successfully utilized. Typical synthetic oils include, but are not limited to, polyisobutylene, polybutenes, hydrogenated polydecenes, polypropylene glycol, polyethylene glycol, trimethylpropane esters, neopentyl and pentaerythritol esters, di(2-ethylhexyl) sebacate, di(2-ethylhexyl) adipate, dibutyl phthalate, fluorocarbons, silicate esters, silanes, esters of phosphorus-containing acids, liquid ureas, ferrocene derivatives, hydrogenated synthetic oils, chain-type polyphenyls, siloxanes and silicones (polysiloxanes), alkyl-substituted diphenyl ethers typified by a butyl-substituted bis(p-phenoxy phenyl) ether, phenoxy phenylethers. Ester-based lubricants are highly suitable.

The fuels contemplated are liquid hydrocarbon combustion fuels, including oxygenated and alcoholic fuels as well as distillate fuels and fuel oils.

It is to be understood, however, that the compositions contemplated herein can also contain other materials. For example, corrosion inhibitors, extreme pressure agents, low temperature properties modifiers and the like can be used as exemplified respectively by metallic phenates sulfonates, polymeric succinimides, non-metallic or metallic phosphorodithioates and the like. These materials do not detract from the value of the compositions of this invention, rather the materials serve to impart their customary properties to the particular compositions in which they are incorporated.

The following examples are merely illustrative and not meant to be limitations.

EXAMPLE 1

A solution of bis-(hydroxyethyl)cocoamine (100 g, 0.37 mol) in 100 ml toluene was prepared in a stirred glass reactor equipped with heater, condenser and Dean-Stark trap. Mercaptoacetic acid (67 g, 0.73 mol) was then added to the reactor solution. The solution was refluxed for 4 hours or until 13 ml $H_2O$ was collected in the Dean-Stark trap. The solvent was evaporated under a reduced pressure to afford the product as a yellowish oil (151 g).

EXAMPLE 2

A solution of triethanol amine (100 g, 0.67 mol) in 150 ml toluene was prepared in a stirred glass reactor equipped with heater, condenser and Dean-Stark trap. Mercaptoacetic acid (185 g, 2.0 mol) was then added to the reactor solution. The solution was refluxed for 5 hours or until 36 ml $H_2O$ was collected in the Dean-Stark trap. The solvent was evaporated under a reduced pressure to afford the product as a yellowish oil (240 g).

EVALUATION

The thioketals thus obtained were blended into mineral oils and evaluated using the Four-Ball Wear Test at 60 kg load/2000 rpm/200° F. for 30 min (Table 1).

In the Four Ball Test three stationary balls are placed in a lubricant cup and a lubricant containing the compound to be tested is added thereto, and a fourth ball is placed in a chuck mounted on a device which can be used to spin the ball at known speeds and loads. The examples were tested using half inch stainless steel balls for thirty minutes under 60 kg load at 2000 rpm and 200° F. If additional information is desired consult test method ASTM D2266 and/or U.S. Pat. No. 4,761,482.

TABLE 1

| Four-Ball Wear Test 60 kg/2000 rpm/30 min/200° F. | | |
|---|---|---|
| Item | Additive Concentration. wt % | Wear Scar Diameter, mm |
| Base Oil (80% solvent paraffinic bright, and 20% solvent paraffinic neutral lubricant oils) | — | 3.29 |
| Example 1 in above oil | 1.0 | 1.46 |
| Example 2 in above oil | 1.0 | 0.80 |

The Four-Ball Wear Test results demonstrate the excellent antiwear properties of these compositions when used at only 1% concentration in mixed mineral oils.

Thioesters derivatized from amines are an entirely new class of compounds which exhibit good antiwear properties in mineral oils under severe service conditions as exemplified by the above test data. These properties enhance the antiwear characteristics of premium quality automotive and industrial lubricants and extend their service life. These compounds can be easily manufactured with known additive technologies and also advance next-generation, premium quality, automotive and industrial lubricants, greases and fuels.

Although the present invention has been described with preferred embodiments, it is to be understood that modifications and variations may be resorted to, without departing from the spirit and scope of this invention, as those skilled in the art will readily understand. Such variations and modifications are considered within the purview and scope of the appended claims.

We claim:

1. An improved lubricant composition comprising a major proportion of said lubricant and a minor proportion of a multifunctional antiwear additive product of reaction prepared from the reaction of a suitable sulfur-containing compound selected from the group consisting of mercaptans and mercapto-derived compounds which contain at least one carboxylic functionality and an alkanol amine in molar ratios varying from 1:10 to 10:1 of alkanol amine to sulfur compound at temperatures varying from ambient to about 300° C. under pressures varying from ambient to 10 atm for a time sufficient to obtain an amine-derived thioester additive product of reaction.

2. The composition of claim 1 wherein the product has the following generalized structure:

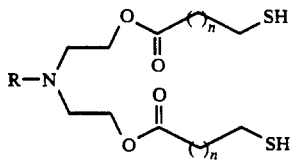

where n = 1−100 and wherein R = $C_1$ to about $C_{60}$.

3. The composition of claim 1 wherein the product has the following structural formula:

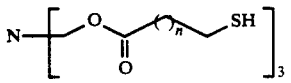

Where n = to 1−100.

4. The composition of claim 1 wherein an amine-derived thioester is prepared from the reaction of bis(-hydroxyethyl)cocoamine and mercaptoacetic acid.

5. The composition of claim 1 wherein an amine derived thioester is prepared from the reaction of triethanol amine and mercaptoacetic acid.

6. The composition of claim 1 wherein the lubricant is an oil of lubricating viscosity selected from the group consisting of (1) mineral oils, (2) synthetic oils, (3) or mixtures of mineral and synthetic oils or is (4) a grease prepared from any one of (1), (2) or (3).

7. The composition of claim 6 wherein the lubricant contains from about 0.001 to about 10 wt % based on the total weight of the composition of the additive product of reaction.

8. The composition of claim 6 wherein the lubricant is a synthetic oil.

9. A process of preparing a multifunctional antioxidant, antiwear additive product prepared by reacting a suitable sulfur-containing compound selected from the group consisting of mercaptans and mercapto-derived compounds which contain at least one carboxylic functionality and an alkanol amine in molar ratios varying from 1:10 to 10 to 1 of alkanol amine to sulfur compound at temperatures varying from ambient to about 300° C. under pressures varying from ambient or 1 atm to about 10 atm for a time sufficient to obtain an amine-derived thioester additive product of reaction.

10. The process of claim 9 wherein the product has the following generalized structure:

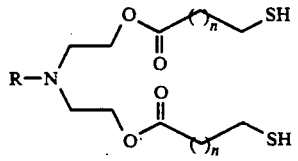

Where n = 1−100 and wherein R = $C_1$ to about $C_{60}$.

11. The process of claim 9 wherein the product has the following generalized structure:

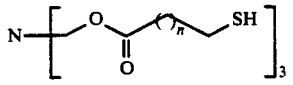

Where n = 1−100.

12. The process of claim 9 wherein an amine-derived thioester is prepared from the reaction of bis(hydroxyethyl)cocoamine and mercaptoacetic acid.

13. The product of reaction prepared in accordance with claim 9 wherein an amine derived thioester is prepared from the reaction of triethanol amine and mercaptoacetic acid.

14. A product of reaction prepared in accordance with claim 9 wherein the product has the following generalized structural formula:

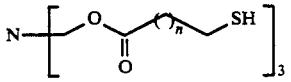

Where n = 1−100.

15. A method of preparing an improved lubricant composition comprising adding to said lubricant a minor multifunctional antioxidant and/or antiwear amount of a product of reaction as described in claim 9.

16. The method of claim 15 wherein said minor amount is from about 0.001 to about 10 wt % based on the total weight of the composition of said additive product of reaction.

* * * * *